United States Patent [19]

Fuchs et al.

[11] Patent Number: 4,610,281

[45] Date of Patent: Sep. 9, 1986

[54] APPARATUS FOR STRAIGHTENING AND SEVERING ROD-LIKE MATERIALS

[75] Inventors: Ernst Fuchs, Schmerikon; Eduard Berger, Degersheim; Karl Fitzi, Hombrechtikon, all of Switzerland

[73] Assignee: Mecapec S.A., Schmerikon, Switzerland

[21] Appl. No.: 664,345

[22] Filed: Oct. 24, 1984

[30] Foreign Application Priority Data

Oct. 27, 1983 [DE] Fed. Rep. of Germany ..... 3338915

[51] Int. Cl.[4] ..... B21F 1/02

[52] U.S. Cl. ..... 140/140; 140/139; 414/748

[58] Field of Search ..... 140/139, 140, 147; 83/320; 72/79, 160, 164, 185; 414/748, 47

[56] References Cited

U.S. PATENT DOCUMENTS

| | | | |
|---|---|---|---|
| 437,413 | 9/1890 | Eckerson | 140/147 |
| 1,925,845 | 9/1933 | Moore | 140/140 |
| 2,219,811 | 10/1940 | Friedman | 140/140 |
| 2,933,202 | 4/1960 | Lanstrom et al. | 414/748 |
| 4,350,065 | 9/1982 | Hayashi et al. | 83/320 |
| 4,391,307 | 7/1983 | Levi et al. | 140/140 |

FOREIGN PATENT DOCUMENTS

| | | | |
|---|---|---|---|
| 631081 | 10/1949 | United Kingdom | 72/164 |

*Primary Examiner*—Francis S. Husar
*Assistant Examiner*—Robert Showalter
*Attorney, Agent, or Firm*—Peter K. Kontler

[57] ABSTRACT

Apparatus for straightening and severing coiled wire or rod stock has several sets of guides each of which receives stock from a different reel and each of which can be moved into and from register with rollers serving to advance the selected stock into one of several straightening devices. A synchronizing unit ensures that the placing of a selected straightening device into a portion of the path along which the stock advances toward and into the range of a severing device downstream of the straightening station invariably entails a movement of the corresponding set of guides into a preceding portion of such path. Each source can contain stock having a different diameter and the severing device moves with the advancing stock in the course of each severing operation.

20 Claims, 6 Drawing Figures

APPARATUS FOR STRAIGHTENING AND SEVERING ROD-LIKE MATERIALS

BACKGROUND OF THE INVENTION

The present invention relates to apparatus for processing rod-like materials, for example, metallic or plastic wire, concrete reinforcing rods and the like. More particularly, the invention relates to improvements in apparatus for straightening and subdividing rod-like materials, especially metallic wire or rods.

Apparatus of the just outlined character are necessary when rod-like material which is to be converted into straight or at least substantially straight sections of predetermined length is stored in the form of coils in barrels, on reels or the like. In accordance with the presently prevailing technique, each such apparatus comprises a straightening device which is followed by a severing device. Each of these devices is designed to treat a particular type of material, e.g., convoluted wire having a predetermined diameter. Consequently, each change of setup so that the apparatus is capable of treating a different wire (e.g., a wire having a larger or smaller diameter) is time-consuming and complex because it is necessary to modify the straightening device as well as the severing device or, at the very least, the straightening device. Long-lasting changes in setup reduce the output of the apparatus and require the presence of skilled attendants. Furthermore, the versatility of such apparatus is rather low because a specific straightening device can only be modified within a certain narrow range in order to process wires or rods having different diameters.

OBJECTS AND SUMMARY OF THE INVENTION

An object of the invention is to provide a novel and improved combined straightening and severing apparatus for rod-like materials whose versatility greatly exceeds that of conventional apparatus.

Another object of the invention is to provide an apparatus which can treat a wide variety of different rod-like materials with the same degree of facility and accuracy.

A further object of the invention is to provide an apparatus which can be converted for the treatment of different types of rod-like material within a fraction of the time which a conversion requires in conventional apparatus.

An additional object of the invention is to provide a novel and improved method of rapidly switching from the treatment of one to the treatment of another rod-like material which requires straightening, severing and, if desired, gathering of severed sections into groups or other types of accumulations.

Still another object of the invention is to provide an apparatus which is always ready to straighten and sever rod-like material of a given type and which can be rapidly converted for treatment of any one of two, three or more different rod-like materials without necessitating replacement of any parts, at least in those portions of the apparatus which serve to guide and straighten the rod-like material prior to subdivision into sections of desired length.

A further object of the invention is to provide a novel and improved system of straightening and guiding means for use in the above outlined apparatus.

Another object of the invention is to provide an apparatus wherein the material is treated gently without scratching or otherwise defacing its surface.

An additional object of the invention is to provide an apparatus which can be used as a superior substitute for an entire battery of conventional straightening and severing apparatus.

The invention resides in the provision of an apparatus for straightening and severing substantially rod-shaped material, particularly for straightening metallic wire or rod stock and for subdividing the straightened stock into sections of desired length. The apparatus comprises means for advancing rod-shaped material in a predetermined direction and along a predetermined path (e.g., along an at least substantially horizontal path), several sources of rod-shaped material (e.g., each such source can comprise a barrel or a reel for a supply of convoluted metallic wire or rod stock), a plurality of mobile guide means, one for each source and each serving to guide the material which issues from the respective source, means for moving selected guide means into register with the advancing means in a first portion of the path (i.e., for moving the selected guide means to a position in which the respective material can be engaged and entrained by the advancing means), straightening means including a plurality of straightening devices, one for each guide means and each serving to straighten the material issuing from the respective source, means for positioning selected straightening devices in a second portion of the path downstream of the first portion (as considered in the predetermined direction) so that the selected straightening device straightens material issuing from the respective source and passing through the corresponding guide means in the first portion of the path, and means for severing the straightened material in a third portion of the path downstream of the second portion.

Each of the guide means can include a plurality of discrete guides which are spaced apart from one another, as considered in the direction of advancement of the material along the path, at least when the respective guide means has been moved into the first portion of the path. The advancing means includes at least one unit which defines the first portion of the path and is flanked by two guides of the guide means in the first portion of the path. If the first portion of the path is defined by two advancing units, each guide means preferably comprises a discrete guide which is located between the two advancing units when a guide means is located in the first portion of the path. In accordance with a presently preferred embodiment of the apparatus, each guide means comprises three at least substantially aligned discrete guides for the respective material and the guides of each guide means are spaced apart from one another, as considered in the direction of advancement of material along the path, at least when the respective guide means occupies the first portion of the path. The advancing means then preferably comprises two advancing units which define the first portion of the path and are spaced apart from each other so that they alternate with the discrete guides of the guide means in the first portion of the path so that each of the two advancing units is flanked by two guides.

The apparatus preferably comprises a common carrier for all of the guide means and the moving means is preferably arranged to move (e.g., pivot) the carrier with reference to the path. The straightening means preferably comprises a common support (e.g., an indexible turret) for the straightening devices and the positioning means is then arranged to move the support relative to the path. Such apparatus preferably further comprises means for synchronizing the operation of the positioning means with that of the moving means for the guide means so that the movement of a selected guide means into the first portion of the path automatically entails the positioning of the corresponding straightening device in the second portion of the path.

As mentioned above, the advancing means preferably comprises at least one advancing unit which defines the first portion of the path, and the advancing means preferably further comprises at least one second advancing unit between the second and third portions of the path to draw the material through the selected straightening device. The apparatus preferably further comprises discrete drive means (e.g., electric motors) for the various units of the advancing means. Each advancing unit can comprise a pair of rollers defining a nip for the respective material. Means can be provided for moving the severing means in and counter to the predetermined direction, so that the severing means advances in the predetermined direction during severing of the material in the third portion of the path at or close to the speed of forward movement of the material.

The apparatus can further comprise suitable means for monitoring the length of the material which advances toward the third portion of the path and for actuating the severing means so that the latter subdivides the material into sections of desired length.

Each straightening device can comprise a mobile straightening tool and the apparatus then further comprises drive means for the tool of that straightening device which is positioned in the second portion of the path. Such drive means can comprise a prime mover and a first clutch element which is driven by the prime mover. Each of the tools then comprises a second clutch element which is arranged to be driven by the first clutch element, and such apparatus preferably further comprises means for shifting the prime mover relative to the second portion of the path so as to engage the first clutch element with the second clutch element of that tool which is located in the second portion of the path. The shifting means can include means (e.g., a fluid-operated cylinder and piston unit) for reciprocating the prime mover in and counter to the direction of advancement of the material along the path. The first and second clutch elements can constitute components of a simple or complex friction clutch, electromagnetic clutch or any other suitable clutch.

The apparatus preferably further comprises a magazine or other suitable means for accumulating severed sections of rod-shaped material in a fourth portion of the path downstream of the third portion. For example, the accumulating means can comprise an indexible (rotatable or shiftable) magazine having receptacles or compartments (e.g., in the form of longitudinally extending flutes or grooves) for accumulation of selected numbers of sections.

Each source can be arranged to store a supply of convoluted or looped rod-shaped material.

The motor or motors for that unit or those units of the advancing means which define the first portion of the path is or are preferably reversible so that the material which occupies the second portion of the path can be retracted into the first portion before a different straightening device is moved into the second portion of the path.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
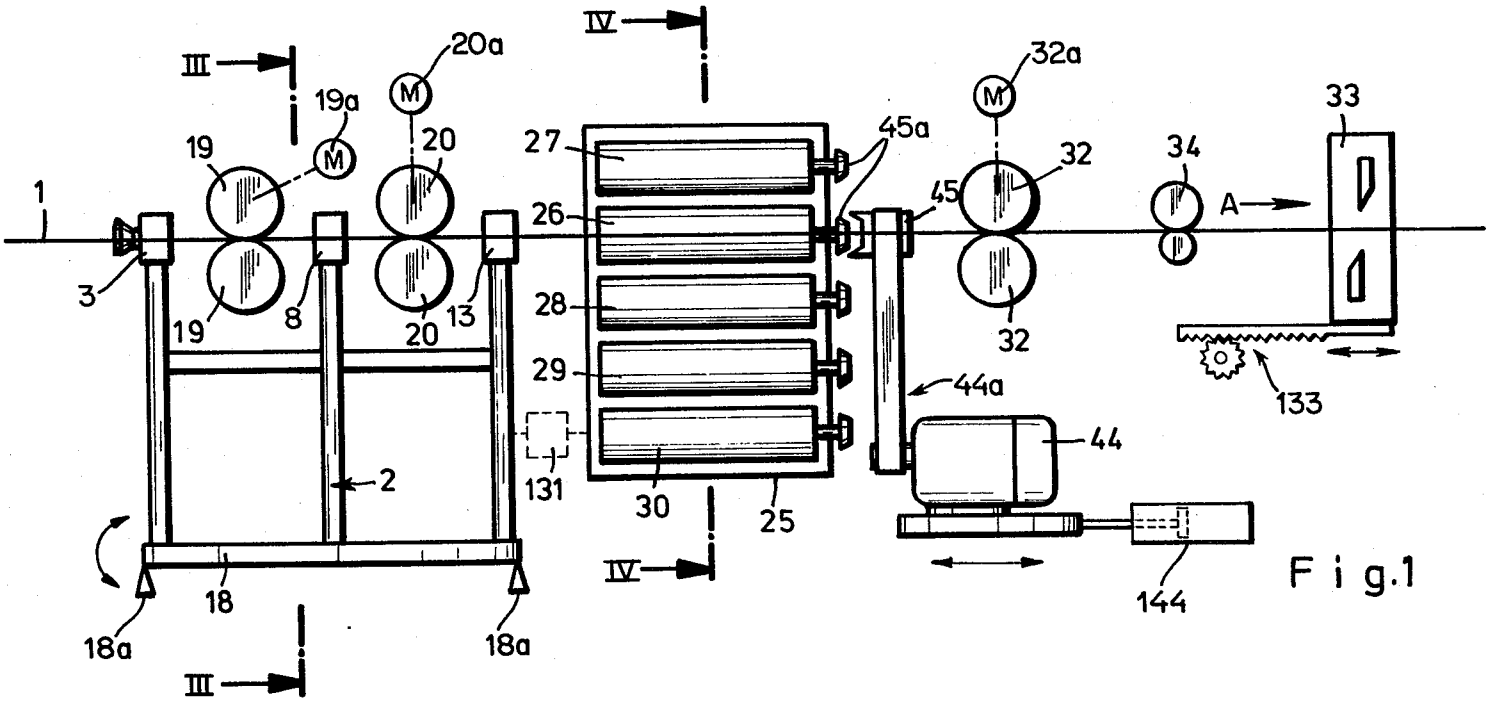
FIG. 1 is a fragmentary schematic elevational view of an apparatus which embodies one form of the invention and comprises five sources of rod-like material.
Figure 2:
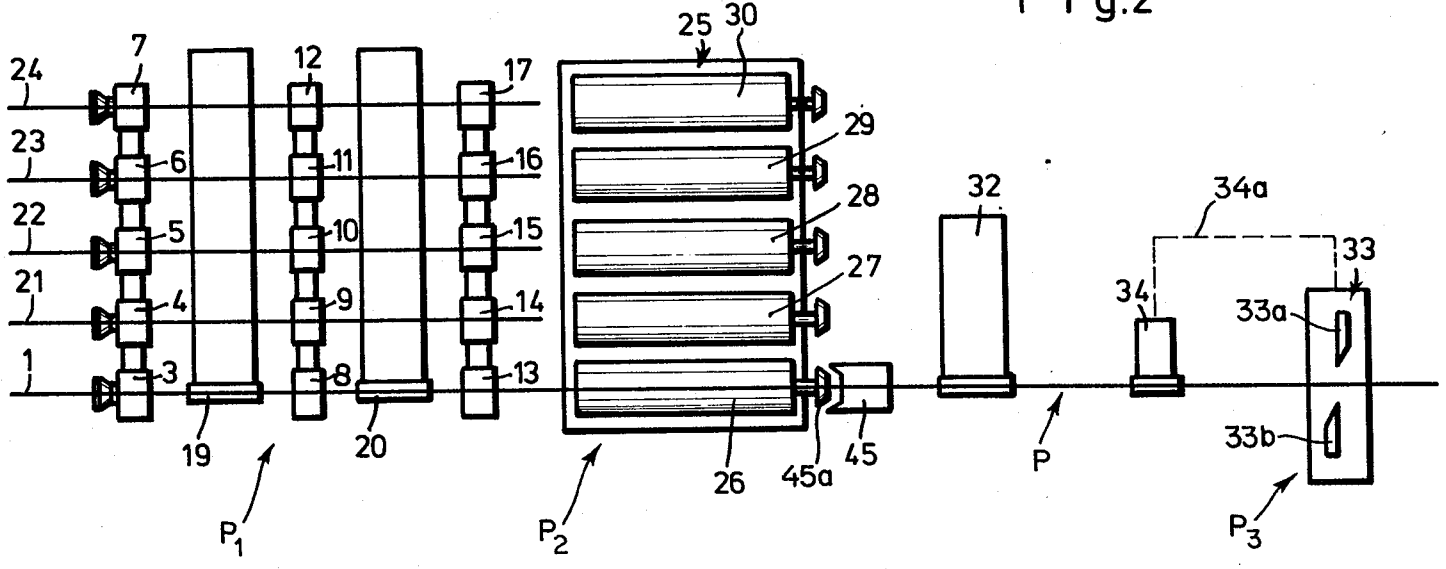
FIG. 2 is a schematic plan view of that part of the apparatus which is shown in FIG. 1.
Figure 3:
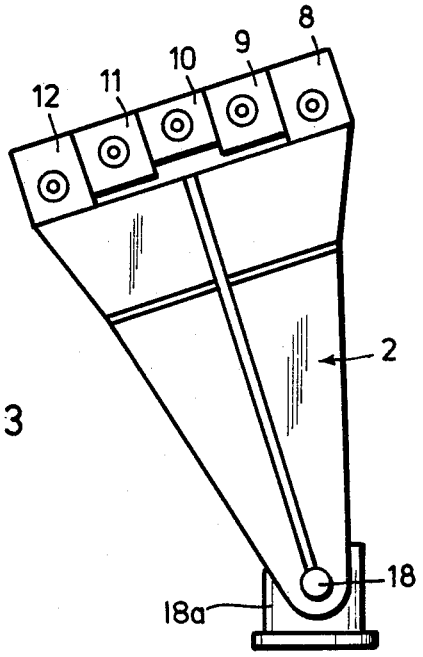
FIG. 3, is an enlarged schematic transverse vertical sectional view as seen in the direction of arrows from the line III—III of FIG. 1.

Referring first to FIGS. 1 and 2, there is shown a portion of an apparatus which is designed to treat five different metallic rod-like materials, e.g., wires or rods (hereinafter called rods for short) 1, 21, 22, 23 and 24 each of which has a different diameter and each of which is being drawn from a different source (note the sources 36, 37, 40, 39, 38 shown in FIG. 5).

The apparatus comprises advancing means including three advancing units 19, 20 and 32 which together define an elongated horizontal path P for lengthwise (axial) transport of the selected rod 1, 21, 22, 23 or 24 in a direction to the right, as viewed in FIGS. 1 and 2 (arrow A). The apparatus further comprises a carrier 2 which is pivotable about a horizontal axis defined by a shaft 18 which is mounted in bearings 18*a* in the frame of the apparatus and is parallel to a first portion $P_1$ of the path P, namely, that portion which is defined by the units 19 and 20 of the advancing means. Each advancing unit can comprise two rollers defining a nip for the selected rod 1, 21, 22, 23 or 24 and a discrete motor (19*a*, 20*a*, 32*a*) for at least one of the rollers. The other roller of each pair of rollers can be biased against the driven roller by a set of springs or the like in a well known manner. The carrier 2 supports five discrete guide means each of which includes three discrete axially spaced apart aligned guides through which the respective rod passes on its way toward the straightening station. The guide means for the rod 1 comprises a front or foremost guide 3 which is nearest to the respective source (36), an intermediate guide 8, and a rear guide 13 which is nearest to the straightening station. The guide means for the rod 21 comprises three discrete (front, intermediate and rear) guides 4, 9 and 14; the guide means for the rod 22 comprises the guides 5, 10 and 15; the guide means for the rod 23 comprises the guides 6, 11 and 16; and the guide means for the rod 24 comprises the guides 7, 12 and 17. FIG. 2 shows that the advancing units 19 and 20 flank the intermediate guides 8–12 of the five guide means and that each of the advancing units 19, 20 is flanked by two discrete guides of each guide means. For example, the advancing unit 19 is flanked by the guides 3 and 8 of the first guide means, and the advancing unit 20 is flanked by the guides 8 and 13 of the same guide means.

The shaft 18 is rigidly connected with the lower portion of the carrier 2 and is rotatable in its bearings 18*a*. This shaft constitutes or forms part of the means for moving the carrier 2 relative to the path P so as to place a selected guide means (e.g., the guides 3, 8 and 13 of the guide means for the rod 1) into the first portion $P_1$ of the path P so that the rod 1 can be engaged and advanced by the units 19 and 20 toward and into the straightening station which is located in a second portion $P_2$ of the path P downstream of the first portion $P_1$ as considered in the direction of arrow A.

Figure 4:
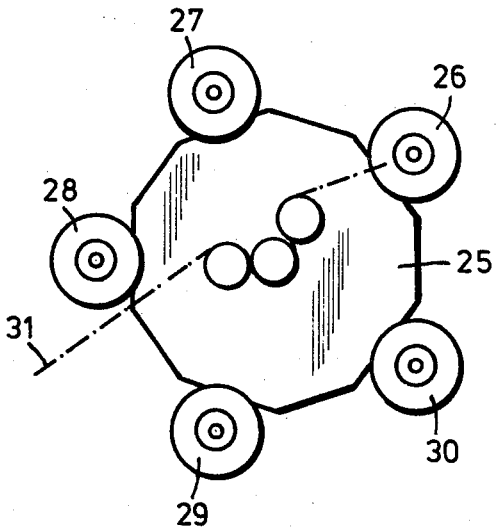
FIG. 4 is an enlarged schematic transverse vertical sectional view as seen in the direction of arrows from the line IV—IV of FIG. 1.

The straightening means of the improved apparatus comprises a support 25 which is preferably (but need not be) an indexible turret supporting five discrete and preferably equidistant straightening devices 26, 27, 28, 29 and 30 for the respective rods 1, 21, 22, 23 and 24. Thus, each of the devices 26–30 is designed to straighten rod-like material having a predetermined diameter. The number of straightening devices, guide means and sources of rod-like material can be reduced to less or increased to more than five without departing from the spirit of the invention. The means for positioning a selected straightening device in the second portion $P_2$ of the path P comprises a chain 31 (see FIG. 4) which serves to index the support or turret 25 about an axis extending in parallelism with the path P. Indexing of the turret 25 is synchronized with movements of the guide means (i.e., with movements of the carrier 2) in such a way that the placing of a selected guide means (e.g., the one including the discrete front, intermediate and rear guides 3, 8 and 13) into the first portion $P_1$ automatically entails the positioning of the corresponding straightening device (26) in the second portion $P_2$ of the path P. The synchronizing means is shown schematically at 131 (FIG. 1) and preferably forms part of an electronic control system which also controls the operation of the motors 19*a*, 20*a*, 32*a*, the means for transmitting motion to the movable part or parts of the selected straightening device 26, 27, 28, 29 or 30, and the means for operating a severing device 33 which is located in a third portion $P_3$ of the path P downstream of the second portion $P_2$ and downstream of the advancing unit 32.

It will be noted that FIGS. 1 and 2 show the support or turret 25 in a developed view in order to illustrate all five straightening devices 26, 27, 28, 29 and 30.

The means for driving the mobile part or parts of the selected straightening device comprises an electric motor 44 or another suitable prime mover and a toothed belt or chain transmission 44*a* which receives motion from the output element of the motor 44 and whose output element is or comprises a first clutch element 45. Each of the straightening devices 26–30 includes a second clutch element 45*a* and the entire prime mover 44 with its transmission 44*a* and clutch element 45 is shiftable in and counter to the direction of arrow A by a suitable shifting device here shown as a fluid-operated cylinder and piston unit 144. The arrangement is such that the control system of the apparatus causes the unit 144 to shift the prime mover 44 to the retracted position of FIG. 1 when the straightening and subdivision of a selected rod (e.g., the rod 1) is to be followed by the straightening and severing of another rod. This disengages the clutch element 45 from the clutch element 45*a* on the mobile part of the device (26) at the straightening station and enables the chain 31 to index the turret 25 so as to move another straightening device into the path portion $P_2$. The unit 144 is then actuated to shift the motor 44 in a direction to the left, as viewed in FIG. 1 and to engage the clutch element 45 with that clutch element 45*a* which is located at the straightening station.

FIGS. 1 to 4 illustrate the improved apparatus in a state when it is ready to straighten the rod 1 and to repeatedly sever the leader of the straightened rod 1 so that the latter yields a file of discrete sections 1*a* (FIG. 6) of desired length. The rod 1 is drawn from the respective source 36 by the advancing units 19 and 20 and successive increments of such rod pass through the guide 3, between the rollers of the advancing unit 19, through the guide 8, through the nip of the rollers constituting the advancing unit 20, through the guide 13, through the straightening device 26 and into the nip of the rollers which constitute the advancing unit 32 so that successive increments of straightened rod 1 are advanced toward and into the range of the severing device 33. The electronic control system further includes a length monitoring device 34 which is located upstream of the path portion $P_3$ and preferably downstream of the path portion $P_2$ so as to measure the length of those portions of the straightened rod 1 which advance past the monitoring station and to transmit to the severing device 33 a signal whenever the latter is to cut across the straightened leader of the rod 1. The operative connection between the monitoring device 34 and the severing device 33 is indicated in FIG. 2 by a broken line 34*a*. The severing device 33 is preferably movable in and counter to the direction which is indicated by the arrow A in such a way that it moves in the direction of arrow A when its knives 33*a* and 33*b* actually sever the rod 1. This ensures that the cutting edges of the knives 33*a*, 33*b* are less likely to scratch or otherwise adversely influence the surface of the rod. The provision of discrete motors 19*a*, 20*a* and 32*a* for the advancing units 19, 20 and 32 serves the same purpose, i.e., to reduce the likelihood of affecting the appearance and/or other characteristics of the sections which are accumulated in a magazine 42 located downstream of the path portion $P_3$. The means for moving the severing device 33 in and counter to the direction of arrow A can comprise a second fluid-operated unit analogous to the unit 144 or a rack and pinion drive 133 shown schematically in the right-hand portion of FIG. 1.

The motors 19*a* and 20*a* for the driven roller or rollers of the advancing units 19 and 20 are preferably reversible so that the leader of the rod (e.g., the rod 1) in the path P can be moved counter to the direction which is indicated by the arrow A and out of the respective straightening device (26) in order to allow for unimpeded indexing of the turret 25 by the positioning means including the chain 31. The leader of the rod 1 continues to extend through the guides 3, 8 and 13 of the respective guide means so that it can be returned into the range of the advancing units 19 and 20 as soon as the carrier 2 is pivoted back to the position in which the leader of the rod 1 is located in the path portion $P_1$.

Figure 5:
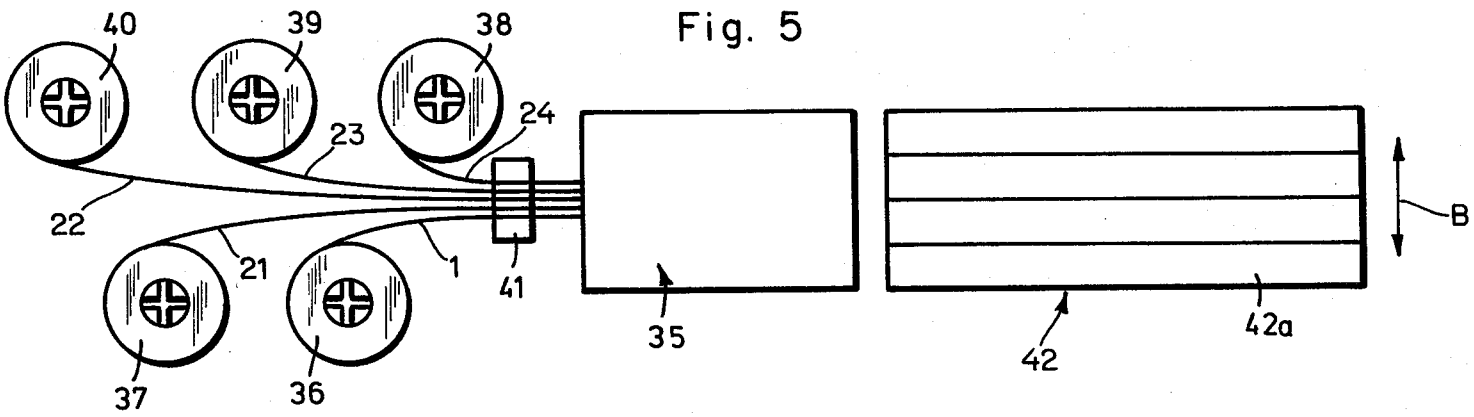
FIG. 5 is a diagrammatic plan view of the entire apparatus, showing the five sources of rod-like material and a device which accumulates sections of a selected severed rod downstream of the severing station.

FIG. 5 shows the entire apparatus. The box 35 denotes diagrammatically that portion of the apparatus which is shown in FIGS. 1 and 2. Each of the sources 36–40 can constitute or comprise a reel which stores the respective rod 1, 21, 24, 23, 22 in convoluted or looped condition so that such stock must be straightened in order to obtain sections which are straight and ready to be bundled or otherwise grouped into packages containing selected numbers of parallel sections. The reference character 41 denotes a further guide which is disposed between the sources 36–40 and the guide means on the pivotable carrier 2. The magazine 42 accumulates or gathers selected numbers of sections of a selected rod in longitudinally extending receiving means or compartments 42*a* each of which can constitute a flute. The entire magazine 42 can be moved (indexed) transversely of the path P (note the arrow B) so as to place a selected flute 42*a* into register with the severing device 33, i.e., into a fourth portion of the path P downstream of the portion $P_3$.

Figure 6:
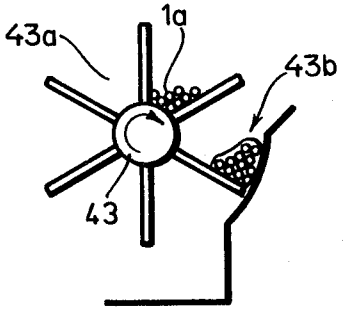
FIG. 6 is a schematic transverse vertical sectional view of a modified accumulating device.

FIG. 6 shows a modified magazine having an indexible wheel 43 defining several receiving means or compartments 43*a* for accumulation of sections of a selected rod. When a compartment 43*a* accumulates a desired number of sections (sections 1*a* of the rod 1 are shown in FIG. 6), the wheel 43 is indexed and the full group of sections 1*a* is moved to a station 43*b* where it is bundled (e.g., with wire or cord), either manually or automatically, labelled and/or otherwise processed for storage or shipment.

The drive means for the movable part or parts of the straightening device 26, 27, 28, 29 or 30 at the straightening station comprises a discrete prime mover 44 for the same reason that the advancing units 19, 20 and 32 comprise discrete motors 19*a*, 20*a* and 32*a*, respectively, i.e., the surfaces of the rods in the path P are less likely to be scratched and/or otherwise affected in the course of advancement, straightening and subdivision into sections of desired length. The same applies for the feature that the severing device 33 is reciprocable in and counter to the direction of arrow A. Gentle treatment of rod-like material is especially desirable and important if the material is a wire-like stock rather than metallic reinforcing rod for embedding in concrete or the like.

An important advantage of the improved apparatus is that the conversion from straightening and severing of a first type of rod-like material to straightening and severing of a different second type of material takes up little time and can be effected in a fully automatic way. Moreover, the material is treated gently and the output of the apparatus is high irrespective of whether it is to straighten and sever wire or rods having a small, medium or large diameter.

The exact construction of the guides in the various guide means and/or of the straightening devices 26–30 on the turret 25 forms no part of the invention. The same applies for the construction of the advancing units 19, 20 and 32, monitoring device 34, severing device 33 and the magazine downstream of the severing device.

In principle all usual types of straightening devices are applicable, but following trials the well known wing-type straightening device provides very good results.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for straightening and severing substantially rod-shaped material, particularly for straightening metallic wire or rod stock and for subdividing the straightened stock into sections of desired length as said material passes along a predetermined path from an upstream source, comprising means for advancing rod-shaped material in a predetermined direction and along said predetermined path having an inlet; several sources of rod-shaped material, said sources being adjacent said inlet; a plurality of mobile guide means downstream of said sources, one for each of said sources and each arranged to guide the material issuing from the respective source; means connected to said guide means for moving selected guide means into register with said advancing means in a first portion of said path adjacent said inlet; straightening means downstream of said guide means including a pluality of independently operable straightening devices, one for each of said sources and each arranged to straighten the material issuing from the respective source, means connected to said straightening devices for positioning selected straightening devices in a second portion of said path downstream of said first portion, as considered in said direction, so that the selected device straightens material issuing from the respective source and passing through the corresponding guide means in said first portion of said path; and means for severing the straightened material in a third portion of said path downstream of said second portion.

2. The apparatus of claim 1, wherein each of said guide means includes a plurality of discrete guides which are spaced apart from one another, as considered in said direction, when the respective guide means is located in the first portion of said path, and said advancing means includes at least one unit which defines the first portion of said path and is flanked by two guides of the guide means in said first portion of said path.

3. The apparatus of claim 1, wherein each of said guide means includes a guide through which the respective material passes on its way from the respective source toward the corresponding straightening device and said advancing means includes two units which define said first portion of said path and flank the guide of the guide means in said first portion.

4. The apparatus of claim 1, wherein each of said guide means includes three at least substantially aligned discrete guides for the respective material, the guides of each of said guide means being spaced apart from one another, as considered in said direction, when the respective guide means is located in said first portion of said path, said advancing means including two units which are spaced apart from one another, as considered in said direction, and alternate with the discrete guides of the guide means in said first portion of said path so that each of said units is flanked by two discrete guides.

5. The apparatus of claim 1, further comprising a common carrier for said guide means, said moving means being arranged to move said carrier with reference to said path.

6. The apparatus of claim 5, further comprising a common support for said straightening devices, said positioning means being arranged to move said support relative to said path.

7. The apparatus of claim 6, further comprising means associated with said positioning means and said moving means for synchronizing the operation of said positioning means with that of said moving means so that movement of a selected guide means into the first portion of said path automatically entails the positioning of the corresponding straightening device in the second portion of said path.

8. The apparatus of claim 1, wherein said advancing means includes at least one first material advancing unit in the region of the first portion of said path, at least one material advancing second unit intermediate the second and third portions of said path, and discrete drive means for said units.

9. The apparatus of claim 8, wherein each of said units comprises a pair of rollers defining a nip for the material in said path.

10. The apparatus of claim 1, further comprising means connected to said severing means for moving said severing means in and counter to said direction so that the severing means advances in said direction during severing of the material in the third portion of said path.

11. The apparatus of claim 1, further comprising means located upstream of said severing means for monitoring the length of material advancing ahead of the third portion of said path and for actuating the severing means so that the latter subdivides such material into sections of predetermined length.

12. The apparatus of claim 1, wherein each of said straightening devices comprises a mobile straightening tool and further comprising drive means for the tool of that device which is positioned in the second portion of said path.

13. The apparatus of claim 12, wherein said drive means comprises a prime mover and a first clutch element driven by said prime mover, each of said tools having a second clutch element which is arranged to be driven by said first clutch element and further comprising means for shifting said prime mover relative to the second portion of said path so as to engage said first clutch element with or to disengage said first clutch element from the second clutch element of the tool in the second portion of said path.

14. The apparatus of claim 13, wherein said shifting means includes means for reciprocating said prime mover in and counter to said direction.

15. The apparatus of claim 1, further comprising means for accumulating severed sections of rod-shaped material in a fourth portion of said path downstream of said third portion.

16. The apparatus of claim 15, wherein said accumulating means includes an indexible magazine having compartments for accumulation of selected numbers of sections.

17. The apparatus of claim 15, wherein said accumulating means comprises a magazine having elongated receptacles for sections of rod-shaped material.

18. The apparatus of claim 1, wherein each of said sources is arranged to store a supply of convoluted rod-shaped material having a predetermined diameter.

19. The apparatus of claim 1, wherein said path is at least substantially horizontal.

20. The apparatus of claim 1, wherein said advancing means includes at least one advancing unit which defines said first portion of said path and reversible motor means for said unit so that the latter can retract rod-shaped material from the second into the first portion of said path preparatory to positioning of a different straightening device in the second portion of said path.

* * * * *